US005618262A

United States Patent [19]

Rene

[11] Patent Number: 5,618,262

[45] Date of Patent: Apr. 8, 1997

[54] UNDULATING MASSAGER UNIT

[75] Inventor: Pierre Rene, Nicolet, Canada

[73] Assignee: Ultrassage Inc., Mont-Royal, Canada

[21] Appl. No.: 488,833

[22] Filed: Jun. 9, 1995

[30] Foreign Application Priority Data

Jun. 10, 1994 [CA] Canada ..... 2125609

[51] Int. Cl.[6] ..... A61H 15/00

[52] U.S. Cl. ..... 601/116; 601/99; 601/100; 601/102; 601/128

[58] Field of Search ..... 601/84, 97–99, 601/89–92, 94, 100, 102, 115, 116, 122, 126–128

[56] References Cited

U.S. PATENT DOCUMENTS

| | | | |
|---|---|---|---|
| 2,204,624 | 6/1940 | Rupp | 601/116 |
| 2,445,158 | 7/1948 | Sparhawk | 601/98 X |
| 2,773,498 | 12/1956 | Himmelman | 601/98 |
| 3,039,458 | 6/1962 | Hill | 601/116 |
| 3,640,272 | 2/1972 | Hussey | 601/99 |
| 3,877,422 | 4/1975 | Heuser et al. | 601/116 |
| 3,970,077 | 7/1976 | Dahl | 601/99 |
| 4,192,296 | 3/1980 | St. Mary | 601/99 |
| 4,760,841 | 8/1988 | Holla | 601/99 |
| 5,385,531 | 1/1995 | Jover | 601/116 X |

*Primary Examiner*—Danton D. DeMille
*Attorney, Agent, or Firm*—McFadden, Fincham

[57] ABSTRACT

A massaging apparatus providing a plurality of movable massage members movable on an eccentric cam to provide a wave-like movement. The massage members are carried on a movable carriage, the latter being movably mounted on a frame. The carriage is selectively movable along the frame and further is movable in elevation relative to the frame. The apparatus provides a plurality of directions of motion to provide an enhanced massaging effect.

17 Claims, 3 Drawing Sheets

UNDULATING MASSAGER UNIT

FIELD OF THE INVENTION

The present invention relates to a massage apparatus suitable for installation in a chair or bed or the like fixture. More particularly, the present invention is directed to a massage apparatus having a travelling carriage mounted for slidable, elevational and massaging movement.

BACKGROUND OF THE INVENTION

Generally speaking, the prior art has previously proposed several arrangements which are useful for massaging the user, the massaging arrangements typically being provided in beds, chairs and the like. Typical of the prior art known in this field is U.S. Pat. No. 5,020,518, issued Jun. 4, 1991 to Spears et al. The reference provides a travelling carriage having massaging rollers positioned for slidable movement on the carriage together with kneading motion of the rollers relative to the carriage.

The arrangement, although useful, includes a rack and pinion arrangement for effecting movement of the carriage and further includes individual motor means and cam means in a complex arrangement.

Chaplar, in U.S. Pat. No. 4,469,093, issued Sep. 4, 1984, provides a relaxing massager. This references relates to the use of a camshaft and lifter bars for providing an undulating massage to a user contacting the arrangement.

This is a useful arrangement, however, the arrangement does not provide a user with any additional degrees of freedom with respect to other possibilities for moving the table. In this regard, the relaxing massager as taught by Chaplar would appear to be limited to the use of a table arrangement where the user must lie on the table.

Further still, U.S. Pat. No. 5,271,386, issued to Thompson, Dec. 21, 1993, teaches a further variation on a massage table. In the arrangement disclosed, the patentee provides a simple roller arrangement associated with a carriage. The carriage is mounted for slidable movement relative to the table structure and the arrangement additionally provides for vibratory motion. Similar to U.S. Pat. No. 4,469,093, this reference is generally limited to cable arrangements where the user must lie on the table to realize the massaging effect.

U.S. Pat. No. 5,103,808, issued to Iams et al., provides a device for manipulating the spine. The arrangement provides spaced apart reciprocal thruster members which reciprocate between a first position into a support bed and a second position thrusting into pressured contact with the patient's back. The arrangement provides longitudinal movement of the massaging elements relative to the bed, however, there is no provision for further movement in different directions.

In view of the prior art that exists in the massaging apparatus art, there exists a need for a massaging arrangement which may be readily incorporated into, for example, a bed, a crib, a chair and other such articles of furniture and further which provides the user with a massaging arrangement which is capable of movement in a plurality of directions.

One object of one embodiment of the present invention is to provide an improved massaging apparatus.

A further object of the present invention according to a further embodiment thereof is to provide a massaging apparatus comprising frame means, carriage means including a plurality of movable massage members, first actuation means for effecting movement of the massage members in a wave-like formation, second actuation means for effecting elevational movement of the carriage means relative to the frame means, and selectively operable drive means for driving the first actuation means and the second actuation means.

In one embodiment, the actuation means may comprise simple camshafts having a plurality of eccentric cams thereon. The camshafts may be driven by a suitable motor.

The drive means may comprise suitable motors which are capable of either simultaneously or individually driving the actuation means.

Yet another object of the present invention there is provided a multiple-direction massaging apparatus comprising frame means, carriage means movably mounted on the frame means and adapted for movement in a first direction, the carriage means movable in a second direction on the frame means different from the first direction, massage means mounted on the carriage means adapted for movement relative to said carriage means in a third direction, and selectively operable drive means for driving the carriage means and the massaging means.

By including drive means for driving the carriage longitudinally of the frame and together with the additional provision of providing an undulating or wave-like motion to the massage members, the apparatus effectively provides a "travelling wave" to produce a pleasant massaging effect.

By further providing elevational movement to the apparatus, the user can optionally enjoy a three-direction massage.

With respect to the massage members, any suitable rollers may be provided and such rollers may be composed of a hard material or of some suitable cushioned material, e.g. foam.

The motors may be driven by conventional means or in the alternative, may be battery operated. In addition, the motors will be connected for selective operation in any one of the directions indicated or all of the directions simultaneously. Suitable switches or infrared arrangements will be employed for operating the motors.

Having thus generally described the invention, reference will now be made to the accompanying drawings, illustrating preferred embodiments.

DETAILED DESCRIPTION OF THE PREFERRED EMBODIMENTS

Figure 1:
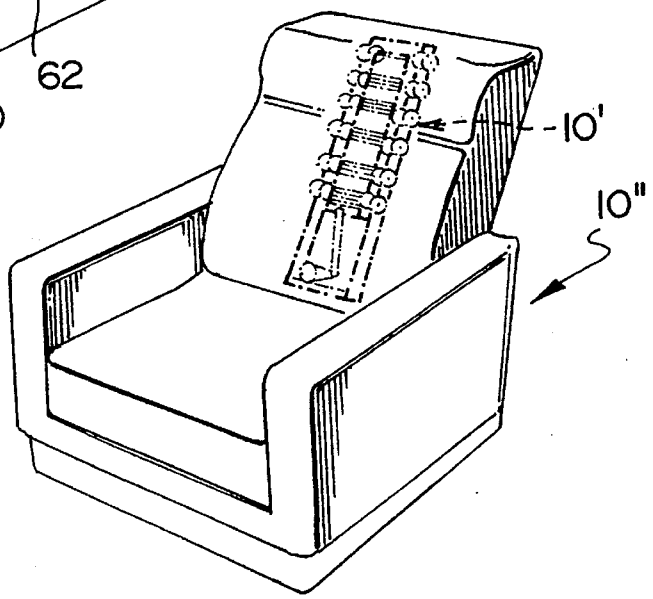
FIG. 1 is a perspective view of the arrangement according to one embodiment of the present invention as positioned in an article of furniture.

FIG. 1 illustrates the arrangement 10' as positioned in an article of furniture, shown in the example as a chair 10".

Figure 2:
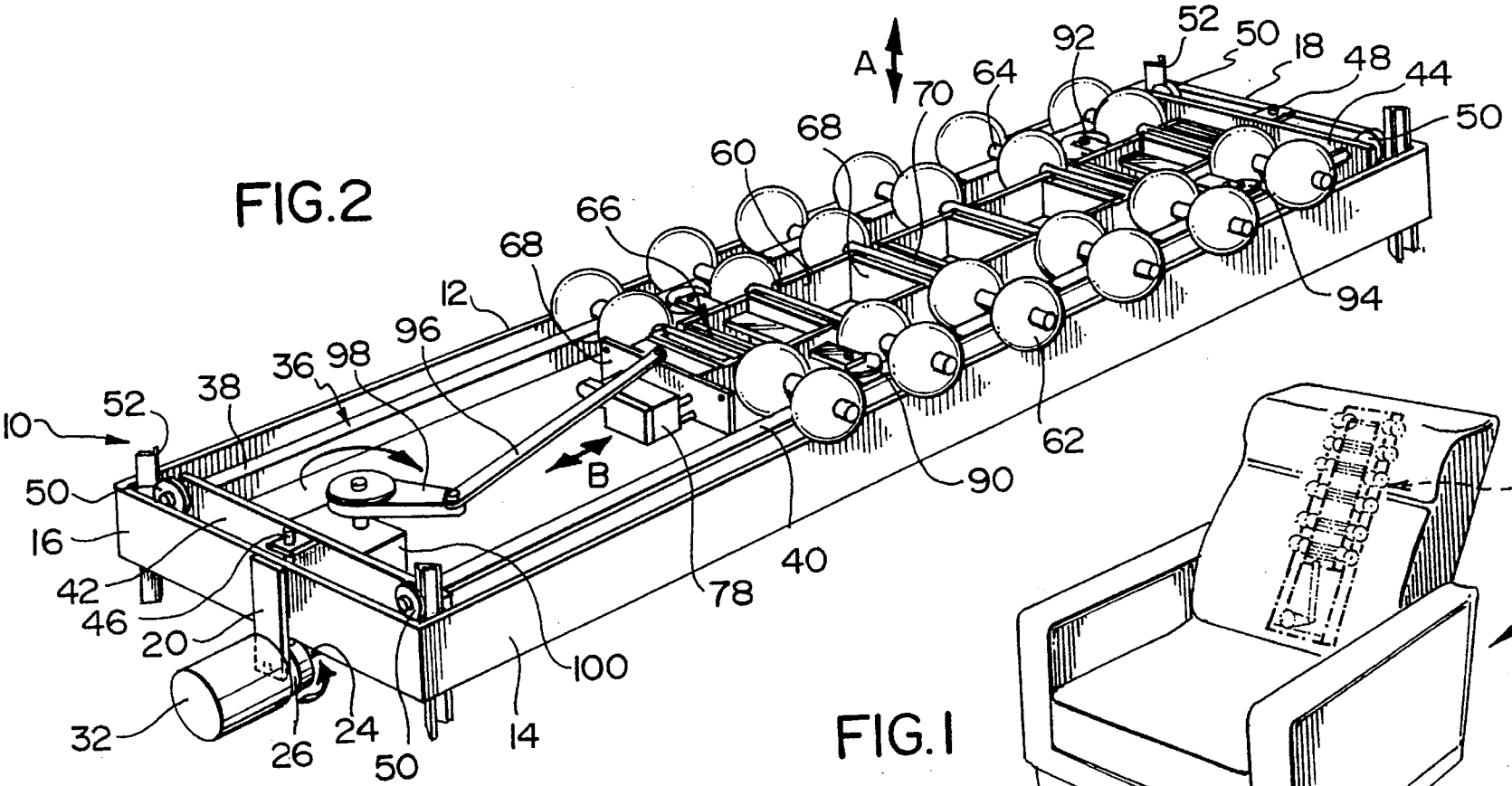
FIG. 2 is a perspective view of the arrangement according to one embodiment.
Figure 3:
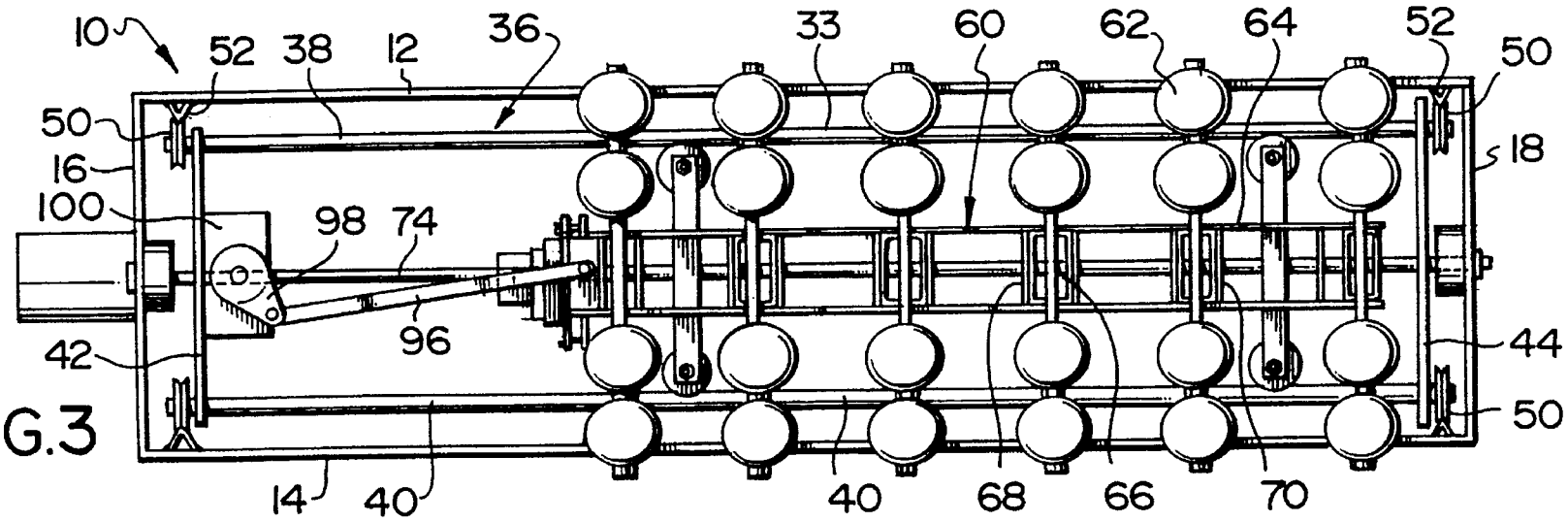
FIG. 3 is a top plan view of the arrangement of FIG. 2.
Figure 4:
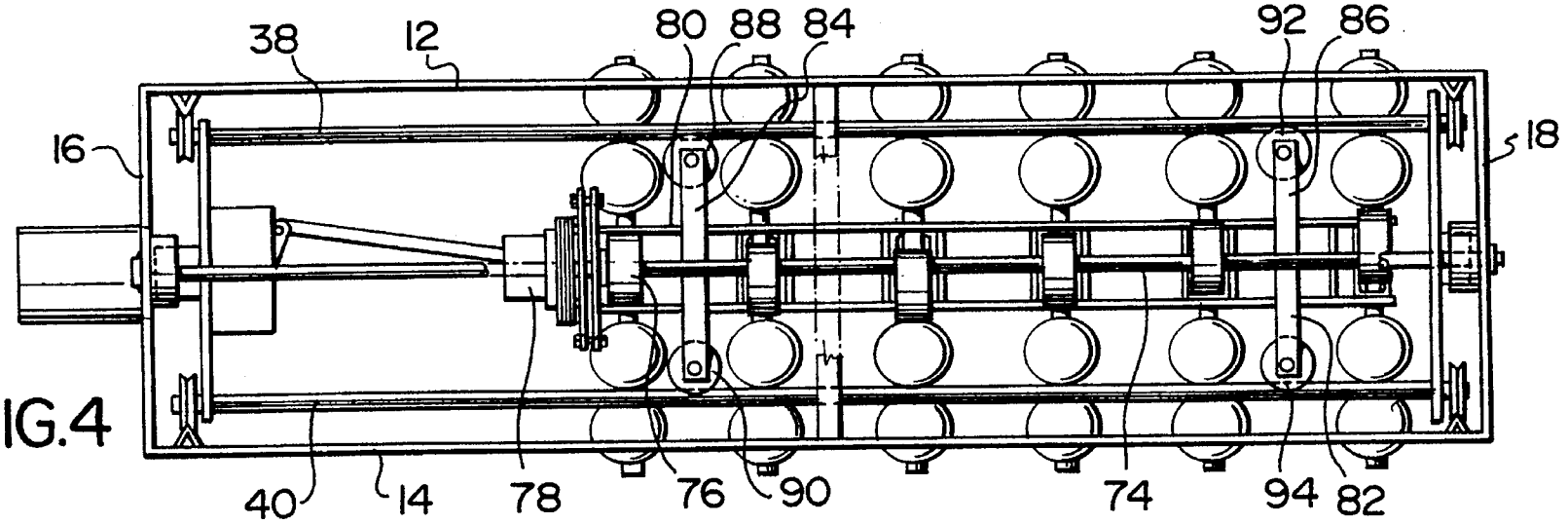
FIG. 4 is a bottom plan view of the arrangement of FIG. 3.

With reference to FIGS. 2 through 4, the arrangement 10' includes a first outer frame 10 comprising a pair of spaced apart longitudinal rails 12 and 14 and end rails 16 and 18. Each of the end rails 16 and 18 includes a camshaft mounting member 20 and 22, shown best in FIG. 6 for rotatably mounting camshaft 24. Camshaft 24 includes cams 26 and 28 adjacent ends 16 and 18, respectively. The camshaft may be selectively rotated by the user by incorporating motor 32 as illustrated in FIG. 3.

Figure 5:
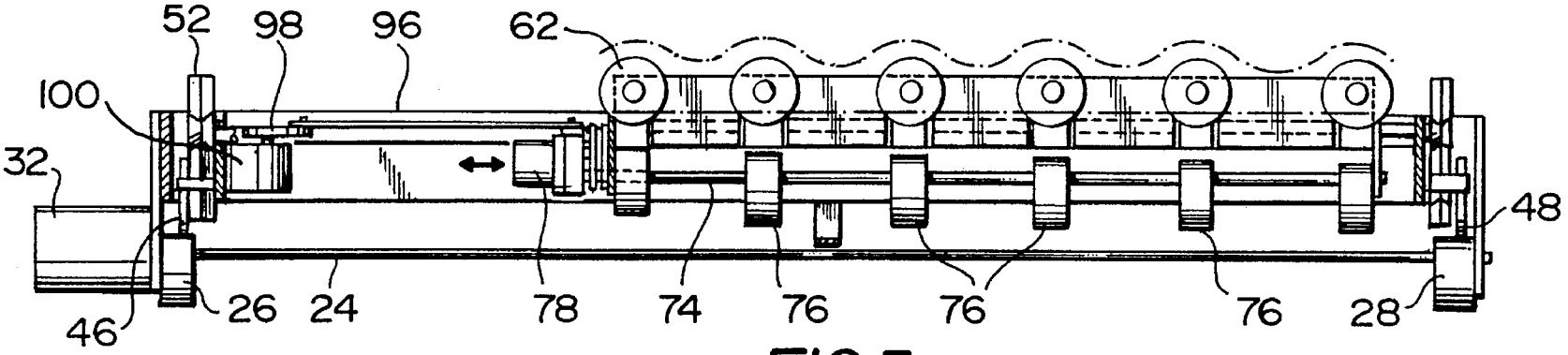
FIG. 5 is a side view of the arrangement illustrated in FIG. 4.
Figure 6:
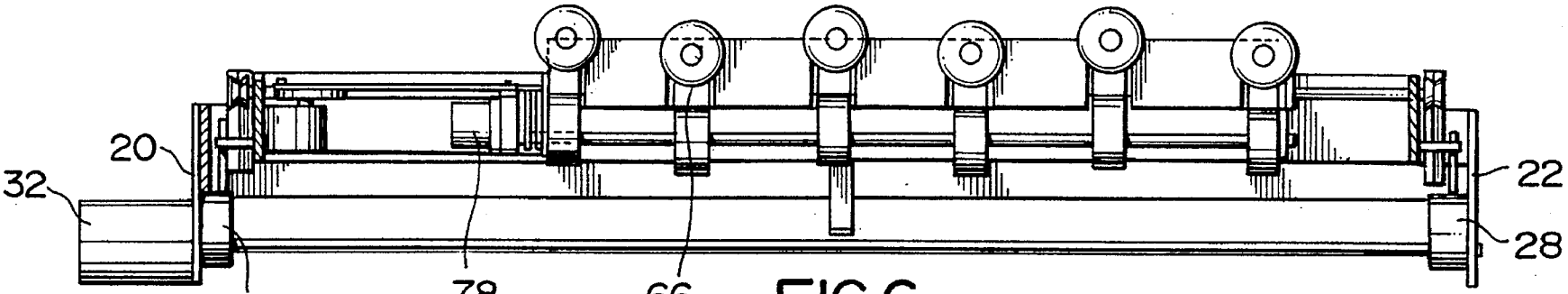
FIG. 6 is a side view, similar to FIG. 5, more clearly illustrating the massaging arrangement.

Movably mounted within frame 12 for movement in an elevational mode relative thereto is a carriage 36. Carriage 36 includes a pair of spaced apart rails 38 and 40 spaced inwardly from frame rails 12 and 14, respectively. Rails 38 and 40 are connected in a spaced apart relationship by end support members 42 and 44, which end members 42 and 44 are spaced inwardly from frame members 16 and 18, respectively. Each end member 42 and 44 includes a lifter member 46 and 48 respectively, which lifter members cooperate with cams 26 and 28, respectively. This arrangement is best illustrated at FIGS. 3, 5 and 6.

Each of the rails 38 and 40 of the carriage 36 includes at their terminal ends rollers 50. Each roller 50 cooperates with guide rail 52, generally adjacent the ends of frame members 12 and 14.

In operation, once motor 32 is activated, the result is that the camshaft rotates and accordingly causes cams 26 and 28 to rotate in their eccentric path as indicated. This results in the lifter members 46 and 48 moving in a like manner and accordingly so does carriage 36 as indicated at A.

In greater detail with respect to the carriage 36, a support frame 60 for supporting a plurality of massaging members 62 are movable relative thereto. The massaging members 62 may comprise generally spherical bodies of which there may be two per side. The bodies may be made of any suitable material, e.g. aluminum, wood, foam, plastic, etc. The spherical members are rotatably mounted to an axle 64 extending from one side of the apparatus to the other and through support 60. The axle permits rotational movement of the massaging members relative thereto. The support 60 includes, for each set of massaging members 62, a vertically movable lifter member 66, vertically movable within guides 68 and 70, extending between the individual walls of support 60. Each one of the massaging members 62 includes such a lifter arrangement.

With specific reference to FIG. 4, there is included a camshaft 74 extending the length of the apparatus so as to provide a plurality of cams 76 eccentrically mounted on camshaft 74. Each of the massage members and more specifically lifters 66 communicates with a cam 76. The camshaft extends between end member 44 of carriage 36 and a distalmost pair of massage members 62. The distalmost end of the camshaft 74 is rotatably mounted to motor 78 selectively operable to rotate camshaft 74 and accordingly cams 76, in order to provide an undulating or wave-like pattern of movement to the individual massage members 62. The wave-like motion is due to the eccentric disposition of the cams 76 on shaft 74. This is additionally shown in FIGS. 5 and 6.

Carriage 36 further includes a pair of roller guide members 80 and 82 which are in a generally parallel relationship with the massage members 62. Each of the roller guide members 80 and 82 includes an axle 84 and 86, which axles rotatably mount rollers 88, 90, 92 and 94. Rollers 88, 90, 92 and 94 cooperate with rails 38 and 40 of carriage 36. In order to provide longitudinal movement of the massaging members 62 relative to frame 10, support 60 includes a linkage arm 96 for connection with a rotating member 98, which rotating member is further connected to a motor 100 in order to provide reciprocating longitudinal movement of the massaging members 62 relative to the frame 12. This direction is generally indicated by arrow B in FIG. 3.

It will be appreciated that any number of massage members may be included in the arrangement by suitable extension of the apparatus. Additionally, it will be readily appreciated by those skilled in the art, depending on the intended use of the apparatus, i.e. whether it is to bemused in a bed, chair or other article of furniture, the frame may be omitted and the apparatus simply installed into an article of furniture having a suitably configured frame with which the remaining apparatus can cooperate.

Further still, it will be readily appreciated that the movements as set forth herein of which the apparatus is capable may be performed in an independent nature or simultaneously to provide elevational, longitudinal reciprocating motion as well as wave-like motion of the massage members.

Although the invention has been described with reference to particular embodiments, it will be appreciated by those skilled in the art that numerous modifications can be made without departing from the spirit and scope of the present invention.

I claim:

1. A massaging apparatus comprising:

frame means;

carriage means for movably mounting a plurality of movable massage members;

first actuation means for effecting movement of said massage members in a wave-like motion;

second actuation means for effecting elevational movement of said carriage means relative to said frame means selectively operable drive means for driving said first actuation means; and selectively operable drive means for driving said second actuation means.

2. The apparatus as defined in claim 1, wherein said apparatus further includes selectively operable carriage drive means for driving said carriage means longitudinally on said frame means.

3. The apparatus as defined in claim 1, wherein said first actuation means comprises a camshaft having a plurality of cams thereon.

4. The apparatus as defined in claim 1, wherein said carriage means includes first and second guide rails in spaced relation for guiding longitudinal movement of said carriage means.

5. The apparatus as defined in claim 4, wherein said carriage means further includes first rollers for cooperation with said guide rails.

6. The apparatus as defined in claim 1, wherein said drive means for said second actuation means includes a selectively operable motor for effecting elevational movement of said carriage means.

7. The apparatus as defined in claim 6, wherein said motor is connected to said camshaft for selective operation of said camshaft.

8. The apparatus as defined in claim 5, wherein said carriage means includes second rollers for facilitating elevational movement of said carriage means relative to said frame means.

9. The apparatus as defined in claim 8, wherein said frame means includes guide rails for guiding said elevational movement of said carriage means.

10. The apparatus as defined in claim 9, wherein said second actuation means comprises a camshaft having at least one cam thereon.

11. The apparatus as defined in claim 10, wherein said frame includes at least one lifter member for contacting said at least one cam.

12. A multiple-direction massaging apparatus comprising:

frame means having a longitudinal axis;

carriage means movably mounted on said frame means and selectively operable for movement in a first direction, said carriage means movable in a second direction on said frame means different from said first direction;

massage means mounted on said carriage means adapted for movement relative to said carriage means in a third direction; and selectively operable drive means for driving said carriage means and said massage means.

13. The apparatus as defined in claim 12, wherein said first direction is a longitudinal direction relative to said longitudinal axis of said frame means.

14. The apparatus as defined in claim 12, wherein said second direction is an elevational direction relative to said frame means.

15. The apparatus as defined in claim 12, wherein said third formation is an undulating wave-like direction relative to said frame means.

16. A multiple direction massaging apparatus, comprising:

frame means having a longitudinal axis;

carriage means movably mounted on said frame means and selectively operable for movement in a longitudinal direction parallel to said longitudinal axis, said carriage means selectively operable for movement in an elevational direction relative to said frame means;

massage means mounted on said carriage means and selectively operable for movement relative to said carriage means in a wave-like formation; and independent selectively operable drive means for driving said carriage means and said massage means at least independently of one another.

17. The apparatus as defined in claim 16, wherein said independent selectively operable drive means is simultaneously operable to drive said carriage means in each said direction and said massage means in said direction simultaneously.

* * * * *